United States Patent [19]

Wenger

[11] Patent Number: 4,763,881

[45] Date of Patent: Aug. 16, 1988

[54] ARRANGEMENT FOR MOUNTING A REFRACTORY PLATE IN A FRAME

[75] Inventor: Otto Wenger, Zürich, Switzerland

[73] Assignee: Metacon Aktiengesellschaft, Zürich, Switzerland

[21] Appl. No.: 739,305

[22] Filed: May 29, 1985

[30] Foreign Application Priority Data

Jun. 7, 1984 [DE] Fed. Rep. of Germany ..... 3421205

[51] Int. Cl.[4] ..... B21D 39/00

[52] U.S. Cl. ..... 266/287; 222/600

[58] Field of Search ..... 266/287, 236, 271; 222/600, 591, 590, 603; 251/326

[56] References Cited

U.S. PATENT DOCUMENTS

| | | | |
|---|---|---|---|
| 4,141,478 | 2/1979 | Meier | 222/600 |
| 4,220,269 | 9/1980 | Beckers et al. | 251/236 |
| 4,265,379 | 5/1981 | Meier | 222/600 |
| 4,508,241 | 4/1985 | Bauer et al. | 222/600 |
| 4,508,324 | 4/1985 | Lührsen et al. | 266/287 |

FOREIGN PATENT DOCUMENTS

| | | |
|---|---|---|
| 371394 | 6/1983 | Austria . |
| 2620423 | 11/1977 | Fed. Rep. of Germany . |
| 8013402 | 8/1980 | Fed. Rep. of Germany . |

*Primary Examiner*—L. Dewayne Rutledge
*Assistant Examiner*—Scott Kastler
*Attorney, Agent, or Firm*—Wenderoth, Lind & Ponack

[57] ABSTRACT

A refractory plate-frame assembly for use in a sliding closure unit includes a frame having therein a recess and a refractory plate positioned within the recess. A flexible band is mounted within the recess about the periphery of the refractory plate. A tightening device is mounted in the frame and is selectively operable from the exterior thereof to tighten the band about the periphery of the plate and thereby securely mount the plate within the recess, and alternatively for loosening the band from the periphery of the plate, whereby the plate may be removed from the band and the frame.

24 Claims, 6 Drawing Sheets

3
10
6
1
2
2a
8
12
11
7
11
12
6
4
10
13
14
14
13

2
6
2a
1
16
11
7
8
11
12
6
15
13
13d
9

ARRANGEMENT FOR MOUNTING A REFRACTORY PLATE IN A FRAME

BACKGROUND OF THE INVENTION

The present invention relates to an arrangement for mounting a refractory plate, i.e. a stationary bottom or lower plate or a sliding plate, to a frame for use in a sliding gate or sliding closure unit of the type for controlling the discharge of molten metal from a metallurgical vessel.

This type of assembly of metallic frame and refractory plate has the same general function in various types of sliding closure units, i.e. of the linear, rotary or pivotal movement type, and whether of the two-plate or three-plate type. In such arrangements, typically the refractory plate is mounted in the metallic frame by use of a refractory mortar. This arrangement however has the disadvantage that it involves a difficult mounting and adjustment procedure. A further disadvantage is that breaking out or removal of a worn refractory plate from the metallic frame is equally awkward.

One known arrangement to overcome such disadvantages is as disclosed, for example, in DE-OS No. 26 20 423, wherein a refractory plate without a metal jacket is mounted in a frame by clamping without mortar by the use of adjustable frame sections constructed as clamping jaws or movable frame portions. A substantial disadvantage of this type of arrangement however is that the fastening forces do not act on the periphery of the plate in an even manner, but rather at concentrated portions of the peripheral area of the plate. As a result, the plate is subjected to tensions, particularly in cooperation with the thermal stresses to which the plate is subjected during operation. These tensions cause deformation of the plate and particularly lead to the formation of cracks therein. The extent of such cracks is accelerated by the uneven peripheral support of the plate. As a result, the plate has a relatively short service life and must be frequently replaced.

Similar disadvantages result from the arrangement disclosed in DE-GM No. 80 13 402, wherein a refractory plate is clamped between two parts of a mounting frame which are connected together by bolts in a detachable manner, and the thus assembled integral unit then is inserted into a frame of the sliding closure unit and is fastened therein by dowels.

To overcome the problem of cracking of the refractory plate due to the above known arrangements, it further is known to provide the refractory plate with a peripheral sheet metal jacket which is integrally and firmly attached to the plate. The resultant assembly then is mounted in a frame of the sliding closure unit. An example of this arrangement is disclosed in Austrian Patent No. 371,394. However, this arrangement has the disadvantages of being expensive to manufacture and being extremely uneconomical since not only the worn plate, but also its sheet metal jacket must be discarded when the refractory plate requires replacement.

SUMMARY OF THE INVENTION

With the above discussion in mind, it is the object of the present invention to provide an arrangement for mounting a refractory plate in a metallic frame whereby it is possible to overcome the above and other prior art disadvantages.

It is a more specific object of the present invention to provide such an arrangement whereby the frame is permanently provided with structure for securely and accurately mounting a refractory plate, whereby the entire peripheral area of the plate is grasped by an even pressure without areas of concentrated clamping forces.

It is a further object of the present invention to provide such an arrangement whereby a refractory plate easily and quickly may be mounted and dismounted as necessary.

These objects are achieved in accordance with the present invention by the provision that the metallic frame has therein a recess of a configuration to receive therein a refractory plate to be mounted. A flexible band is mounted within the recess at a position to extend around the peripheral surface of the refractory plate. Tightening means are mounted in the frame and are selectively operable from the exterior of the frame to tighten the band about the peripheral surface of the plate and thereby to securely mount the plate within the recess of the frame. The tightening means also is selectively operable to loosen the band from the peripheral surface of the plate, whereby the plate may be removed from the band and the frame. By this arrangement, there are achieved the prior art disadvantages of metal jacketed plates, but without the disadvantages thereof. In other words, in accordance with the present invention the refractory plate is protected from concentrated clamping forces, thereby avoiding conditions resulting in cracking of the plate during use. This is achieved without the need for providing the refractory plate with an integral metal jacket, thereby substantially reducing both operating and maintenance costs. Plates without metal jackets are much easier and less expensive to manufacture. The time and effort to provide the refractory plate with the metal jacket is avoided, as well as the substantial expense of the material forming the jacket.

In accordance with a further feature of the present invention, the flexible band is split and has adjacent ends spaced from each other. The tightening means comprises a pair of tightening members provided at the band ends, a pair of clamping members positioned for engagement with respective tightening members, and a spindle supporting the clamping members and having an operating end extending from the frame. As a result, rotation of the operating end in a first direction causes movement of the clamping members toward each other, thereby causing movement of the tightening members and the band ends toward each other, thereby tightening the band about the peripheral surface of the plate. Additionally, rotation of the operating end in a second direction opposite to the first direction causes movement of the clamping members away from each other, thereby enabling movement of the tightening members and band ends away from each other, thus loosening the band from the peripheral surface of the plate. Thus, the band is caused to tightly and frictionally conform to the configuration of the peripheral surface of the plate and thereby to grasp the plate by uniform application of pressure around the entire peripheral surface. This results in a simple manner of operation, yet a significant technological improvement. It will be apparent that it easily will be possible to adjust the relative binding pressure imparted by the band on the peripheral surface of the plate.

In one arrangement of the present invention, which is particularly advantageous for rotary refractory plates having a circular peripheral surface, there is provided only one tightening means. On the other hand, when the plate is to be employed for rectilinear movement and is elongated, then the band is split at positions adjacent opposite longitudinal sides of the plate, and a tightening means is provided at each such position. When the plate is of the type having multiple corners, then tightening means are provided between such corners.

In accordance with a further feature of the present invention, the band or band portions are fastened to the frame or to portions of the frame and/or to jaws mounted on the frame. Such jaws particularly are useful for further fixing of the position of the plate after the band is tightened around the peripheral surface thereof, and such jaws additionally provide the advantage of easier opening of the band when the plate is to be removed from the frame.

The tightening members and clamping members preferably have abutting inclined surfaces, such that these members are in the form of cooperating wedges. This manner of construction is advantageous, because it is easy to achieve a relatively high degree of tightening for a relatively small degree of movement of the tightening and clamping members due to the wedge configuration.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
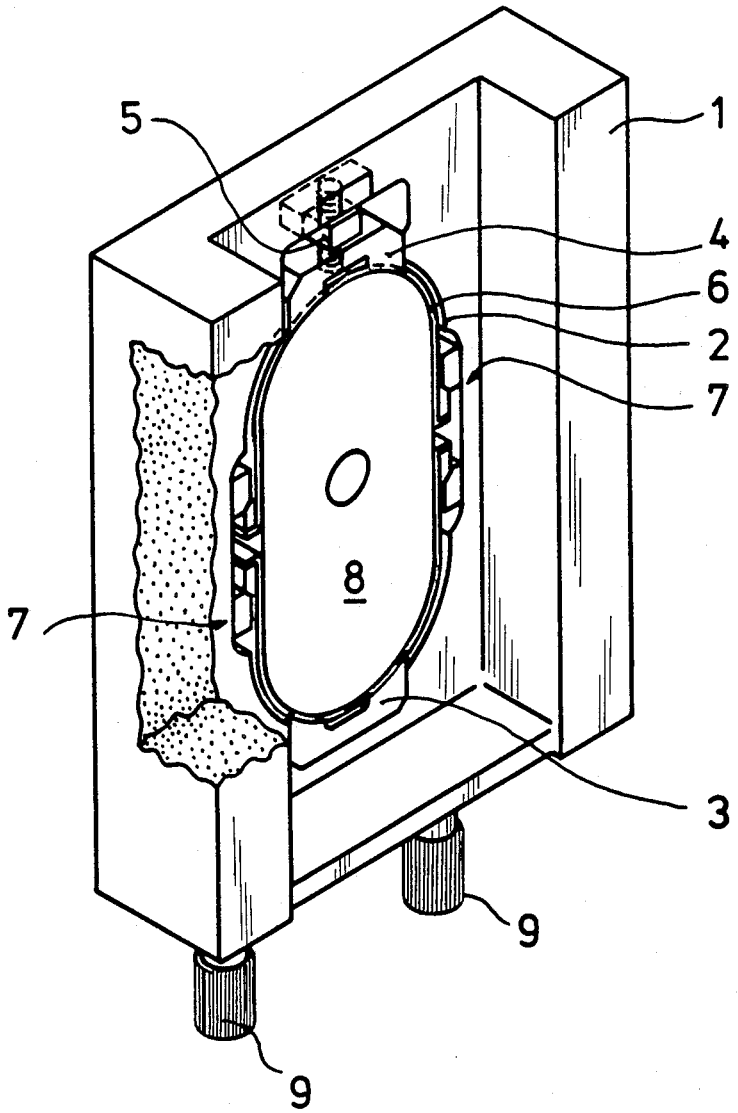
FIG. 1 is a perspective view, with portions broken away, illustrating a first embodiment of the present invention.

In FIG. 1 is illustrated a stationary metal frame 1 for mounting and supporting a stationary refractory plate 8 for use in a linearly movable sliding closure unit. Frame 1 has therein a recess 2 into which is positioned refractory plate 8. A band 6 is mounted within recess 2 to extend around the peripheral surface of plate 8. Band 6 is split at positions adjacent each longitudinal side of plate 8 to form two band portions 6, with adjacent ends of the two band portions spaced from each other. A tightening means 7 is provided for moving each pair of adjacent band ends toward each other or away from each other, thereby alternately tightening the band portions about the peripheral surface of the refractory plate and loosening the band portions from such peripheral surface. Each tightening means is guided along longitudinal side edges of recess 2 and includes means 9 positioned exteriorly of frame 1 for achieving such operations. The specific tightening means contemplated in the embodiment of FIG. 1 will be discussed in more detail below with reference to FIG. 5. After plate 8 is positioned within band 6 in recess 2, operating members 9 are operated to tighten the band around the peripheral surface of the plate. This will result in a uniform application of tightening force around the entire peripheral area of the plate. Final fastening may be achieved between a support jaw 3 mounted at one end of the frame 1 and a clamping jaw 4 movably mounted by means of an adjustment bolt 5 at the opposite end of frame 1.

It will be apparent that refractory plate 8, which frequently wears out and must be replaced, is easy to remove and to replace with a new plate which may be brought into position by only slight manual operation of members 9, 5. The plate will be held in position during use of the assembly. The plate is held together during operation by inner tensions which occur in opposition to binding band 6 and is immovably secured between support and clamping jaws 3, 4 against frictional forces which occur when the sliding closure unit is opened and closed, in a manner as will be understood by those skilled in the art. Band 6 exerts an even surface pressure on the periphery of plate 8 in a manner to avoid the application of unevenly applied support pressure.

Figure 2:
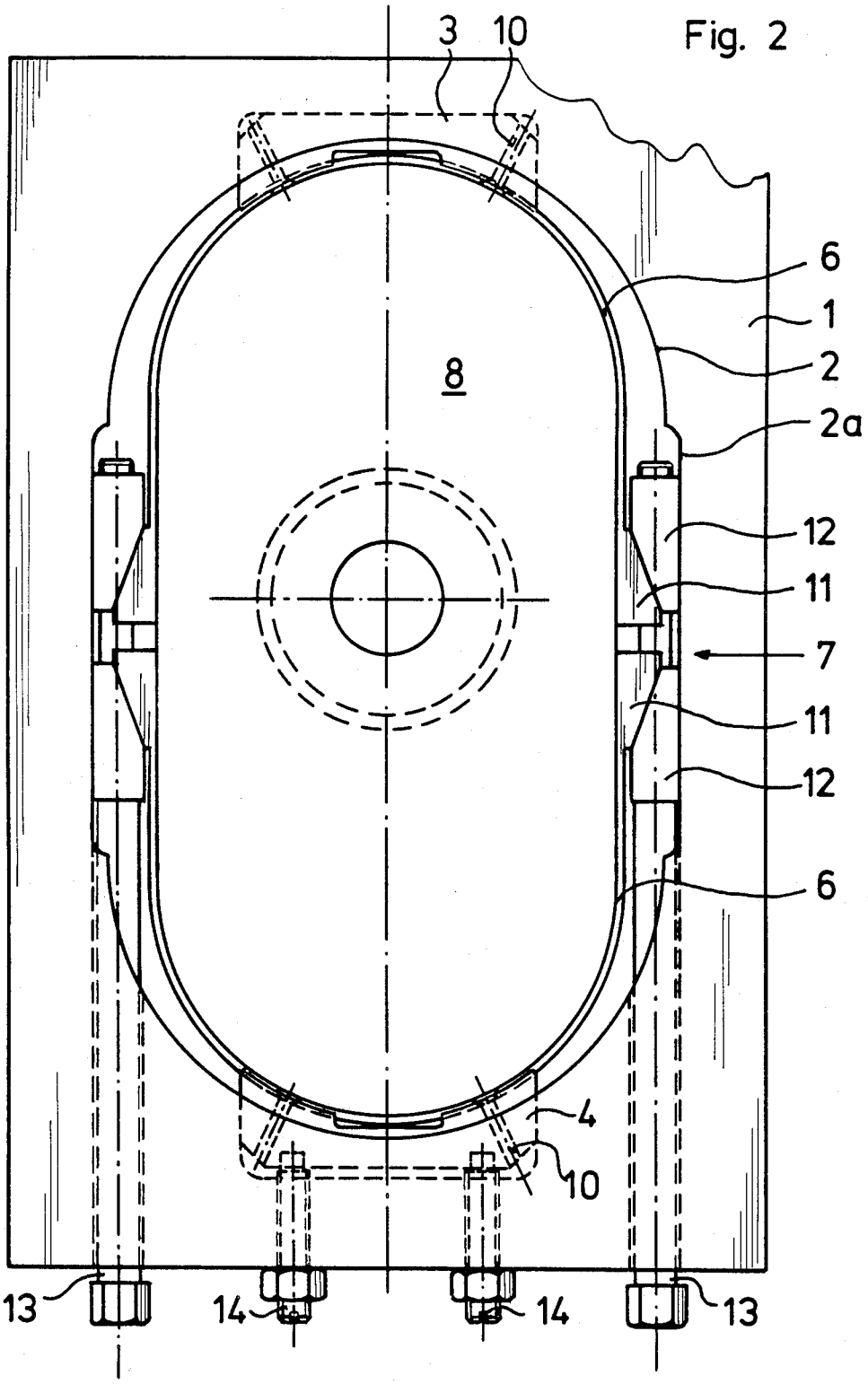
FIG. 2 is a plan view of a second embodiment of the present invention.
Figure 3:
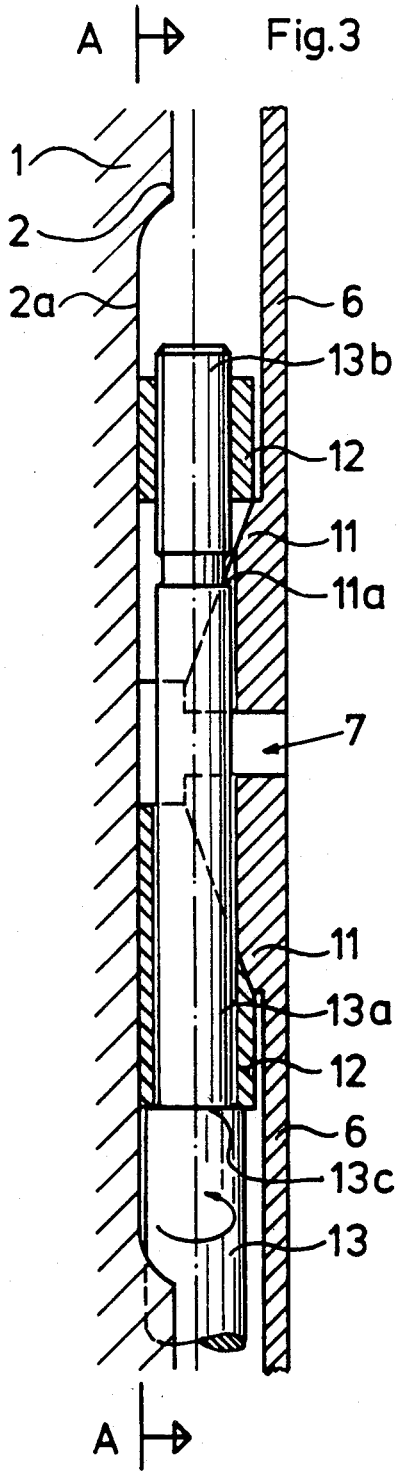
FIG. 3 is a sectional view on an enlarged scale of a portion of the structure of FIG. 2.
Figure 4:
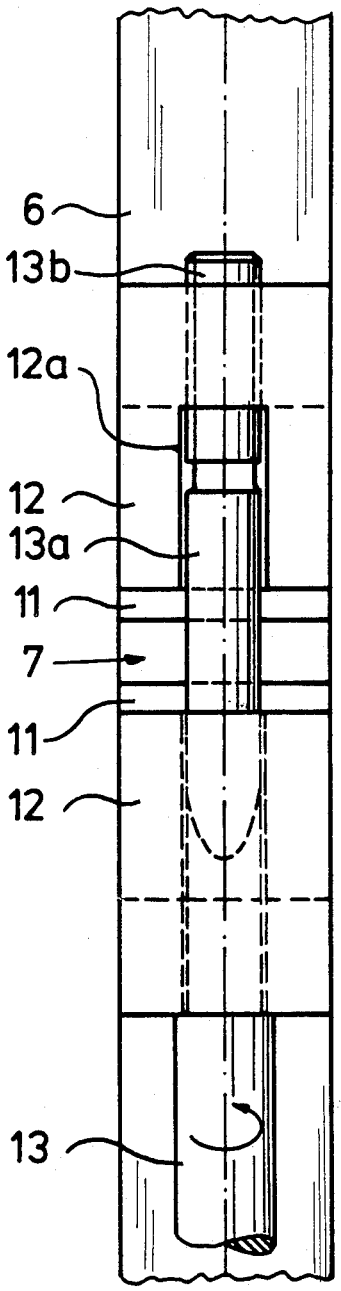
FIG. 4 is a section taken along line A—A of FIG. 3.

The embodiment of FIGS. 2 through 4 illustrates a somewhat modified arrangement. Adjacent band ends of the two band sections 6 have integral tightening members 11 which have inclined surfaces. Each tightening means 7 includes a pair of clamping members 12 having inclined surfaces abutting respective inclined surfaces of respective tightening members 11. As will be apparent particularly from FIG. 3, each clamping member also has a further surface abutted on and guided by a guide surface 2*a* of frame 1, thus preventing rotation of the clamping members. Each tightening means 7 further includes a spindle 13 having an axially outer larger diameter portion rotatably supported by a frame 1 and an axially inner, smaller diameter portion forming a step 13*c* with the larger diameter portion. The smaller diameter portion of the spindle includes a smooth section 13*a* adjacent step 13*c* and a threaded section 13*b* remote from step 13*c*. A first clamping member 12 is threaded onto threaded section 13*b*, and a second clamping member 12 has the smooth section 13*a* extending therethrough. This second clamping member 12 also abuts step 13*c*. The operating end of the tightening means includes structure, such as a bolt head, fixed to the outer end of the larger diameter portion for selectively rotating spindle 13. As a result, when spindle 13 is rotated in a first direction to tighten band portions 6, the two clamping members 12 will be moved toward each other, with the result that the inclined surfaces of clamping members operate on the inclined surfaces of tightening members 11 to move the tightening members and the adjacent band ends toward each other. This will result in the band portions tightening about the peripheral surface of the plate over the entire peripheral area thereof and in a uniform manner. The tightening and clamping members 11, 12 have formed therein respective central slots 11*a*, 12*a* for passage therethrough of spindle 13.

In this embodiment, the band portions 6 are connected to support jaw 3 and clamping jaw 4 by suitable means such as rivets 10. Adjustment screws 14 are provided for adjusting clamping jaw 4.

Figure 5:
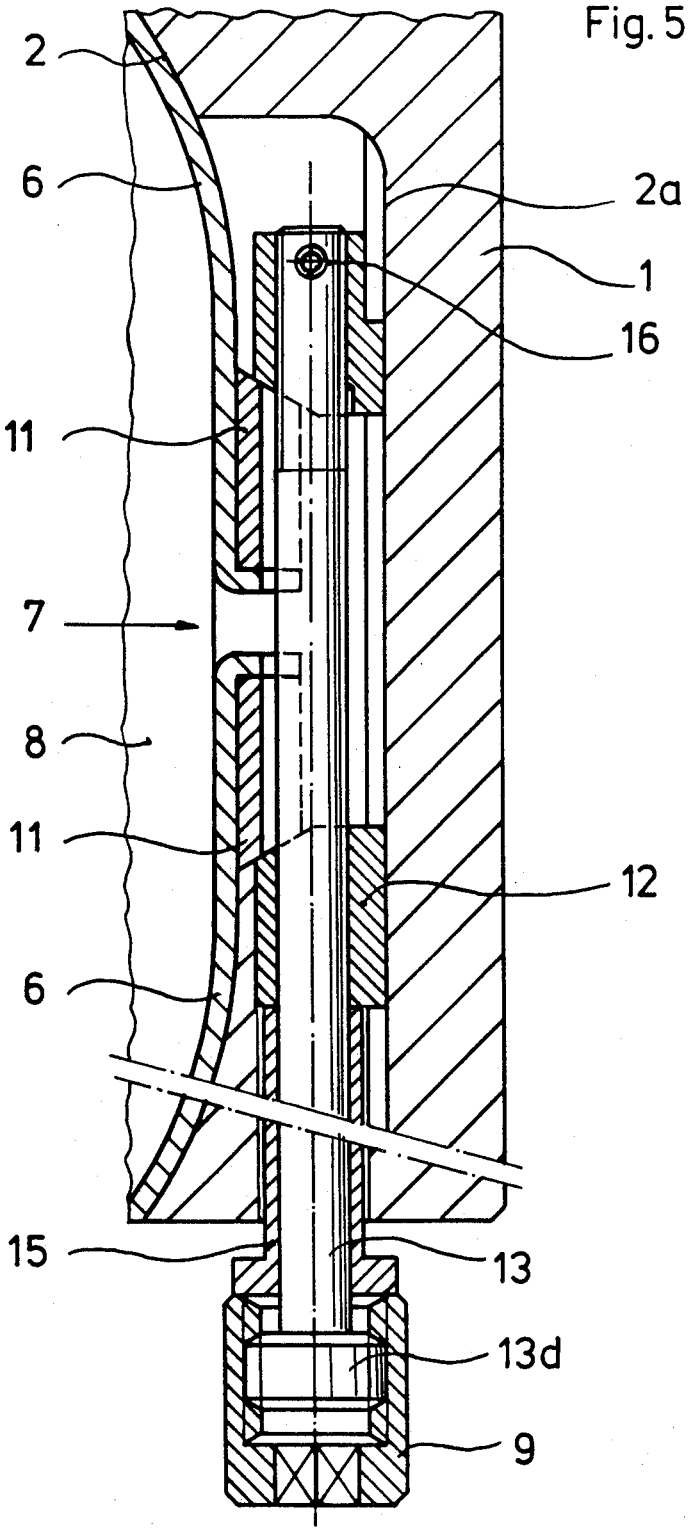
FIG. 5 is a view similar to FIG. 3 but of a modification thereof.

FIG. 5 shows a modification of the tightening means, and the embodiment of FIG. 1 is illustrated as employing the tightening means of FIG. 5. In this arrangement, spindle 13 extends into and is supported by frame 1. A first clamping member 12 is fixed, for example by a cotter pin 16, to an axially inner end of spindle 13. A second clamping member 12 is axially slidably mounted on spindle 13. The operating end or structure comprises a threaded axially outer end portion 13*d* of the spindle. An internally threaded actuating member 9 is threaded onto the outer end portion 13*d* of the spindle. A sleeve 15 has an outer flanged end in abutment with actuating member 9 and an inner end extending into frame 1 and abutting the second clamping member 12. Tightening members 11 are attached to or in abutment with outwardly flanged ends of band portions 6. Alternatively, tightening members 11 could be formed integrally, as per the embodiment of FIGS. 2–4.

Upon rotation of actuating member 9 in a first direction, the sleeve 15 and the clamping member in abutment therewith are caused to move axially of spindle 13 toward the other clamping member 12. Due to the inclined surfaces of the tightening and clamping members 11, 12, the tightening members and respective adjacent ends of band sections 6 are moved toward each other. This results in a uniform tightening of the band portions around the peripheral surface of the plate 8.

Figure 6:
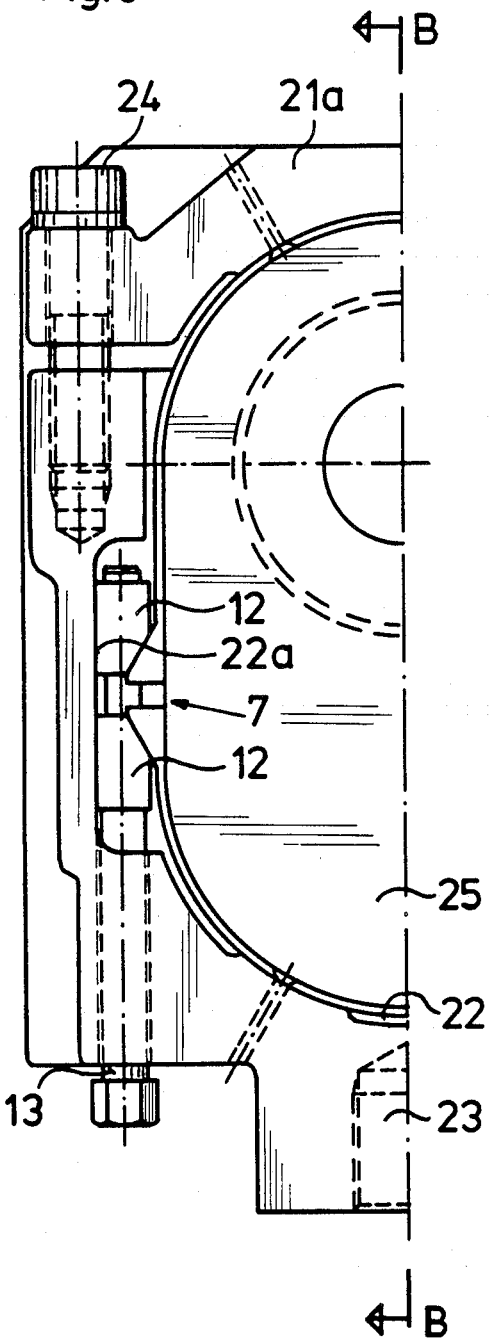
FIG. 6 is a plan view of a further embodiment of the present invention.
Figure 7:
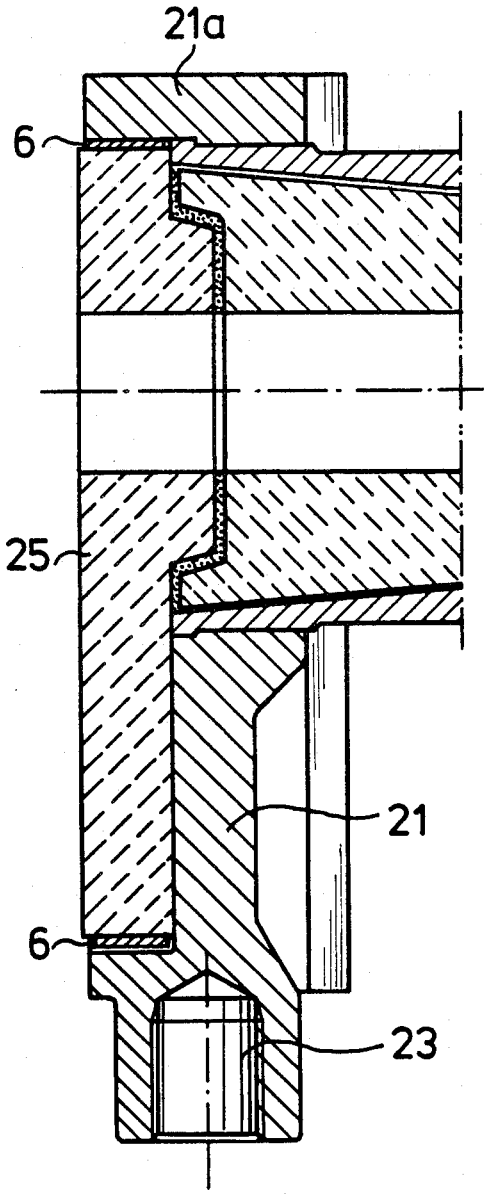
FIG. 7 is a section taken along line B—B of FIG. 6.

FIGS. 6 and 7 illustrate a modification of the assembly of the present invention, particularly suitable for use with a sliding frame for mounting and supporting a linearly slidable plate 25. In this embodiment, the metallic frame includes a main frame section 21 and a separable frame section 21*a* which may be moved toward and away from main section 21 by means of bolts 24. Band portions 6 are connected to and supported by respective frame sections 21, 21*a*, for example by means of rivets. Frame section 21 is provided with tightening means 7, in the illustrated arrangement of the type shown in FIGS. 2–4. It is to be understood however that tightening means 7 could be of the type illustrated in FIG. 5. Refractory plate 25 is mounted within recess 22 formed in frame sections 21, 21*a*. Frame section 21 has a base 23 for connection to an actuating mechanism in a known manner.

Figure 8:
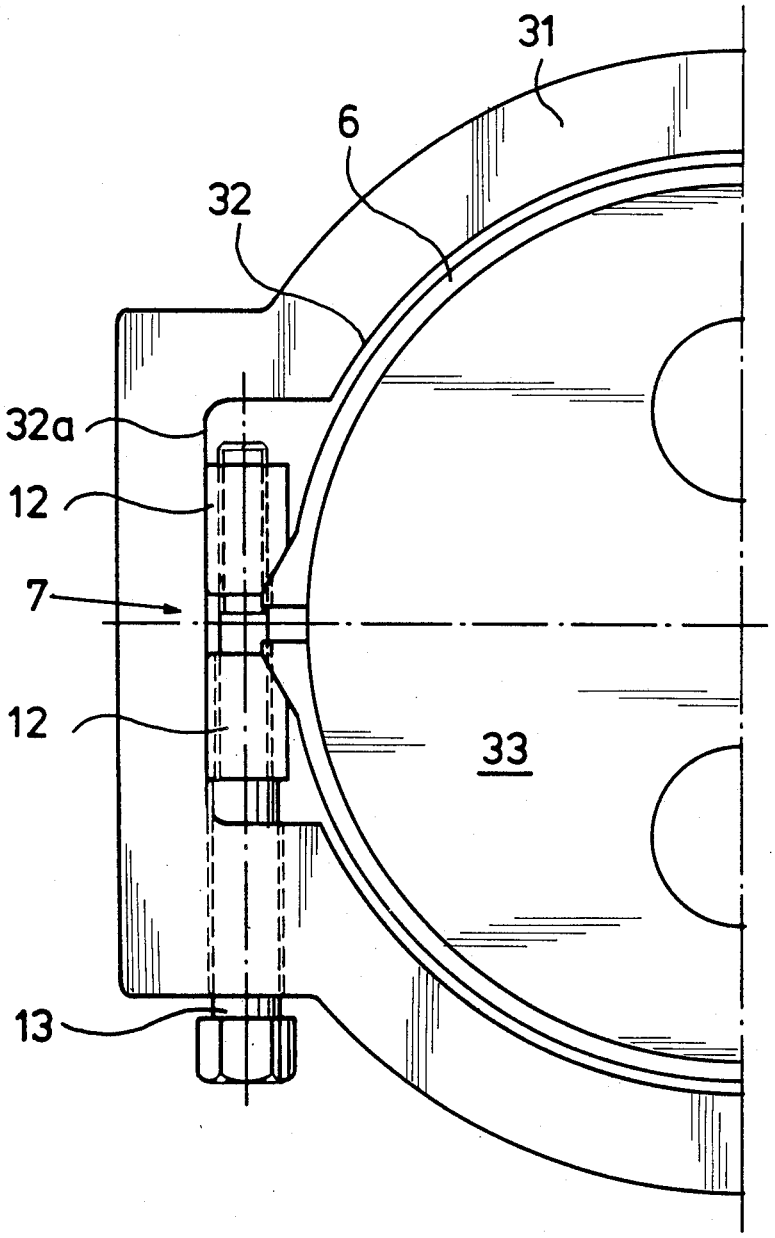
FIG. 8 is a partial plan view of a further embodiment of the present invention.

FIG. 8 illustrates a further modification of the assembly of the present invention, particularly suitable for a rotary refractory plate 3 having a round configuration with a circular peripheral surface. In this embodiment, band 6 is split at only one position, and only a single tightening means 7 is illustrated, since one tightening means is sufficient to ensure an even application of pressure around the circular peripheral surface of plate 33. Plate 33 thus is mounted in recess 32 of frame 31, the clamping members 12 of the tightening means being guided by guide surface 32*a* of the frame. The tightening means 7 illustrated in FIG. 8 is of the type described above regarding the embodiment of FIGS. 2–4. It is to be understood however that the tightening means illustrated in FIG. 5 also could be employed in the embodiment of FIG. 8.

The band or band portions 6 preferably are formed of a flexible material. A flexible steel band is particularly suitable. However, chain-like bands or wire bands also could be employed. Furthermore, the present invention may be employed to mount refractory plates having peripheral shapes other than those described and illustrated, for example oval or multi-cornered peripheral shapes.

Although the present invention has been described and illustrated with respect to preferred embodiments thereof, it is to be understood that various modifications and changes as would be understood by those skilled in the art may be made without departing from the scope of the present invention.

I claim:

1. A refractory plate-frame assembly for use in a sliding closure unit for controlling the discharge of molten metal from a metallurgical vessel, said assembly comprising:

a frame having therein a recess;

a band mounted within said recess;

a refractory plate positioned within said recess and having a periphery surrounded by said band;

tightening means, mounted in said frame and selectively operable from the exterior thereof, for tightening said band about said periphery of said refractory plate and thereby securely mounting said refractory plate within said recess of said frame, and for loosening said band from said periphery of said refractory plate, whereby said refractory plate may be removed from said band and said frame; and said band being mounted within said recess in said frame by means such that said band remains in position on said frame when said tightening means loosens said band and said plate is removed from said band.

2. An assembly as claimed in claim 1, wherein said band is split and has adjacent ends spaced from each other, and said tightening means comprises a pair of tightening members provided at said band ends, a pair of clamping members positioned for engagement with respective said tightening members, and a spindle supporting said clamping members and having an operating end extending from said frame, such that rotation of said operating end in a first direction causes movement of said clamping members toward each other, thereby causing movement of said tightening members and said band ends toward each other, thus tightening said band about said periphery of said refractory plate, and such that rotation of said operating end in a second direction opposite to said first direction causes movement of said clamping members away from each other, thereby enabling movement of said tightening members and said band ends away from each other, thus loosening said band from said periphery of said refractory plate.

3. An assembly as claimed in claim 2, wherein said plate and said recess are elongated rectilinearly and are each defined by spaced elongated side walls joined by rounded end walls, said band is split at positions adjacent each said side wall to define two band portions having adjacent ends spaced from each other at each said position, and a said tightening means is provided at each said position for operation on a respective pair of said band ends.

4. An assembly as claimed in claim 2, wherein said plate and said recess are round.

5. An assembly as claimed in claim 2, wherein said frame includes separable frame portions, said band comprises separate band portions, and each said band portion is fastened to and supported by a respective said frame portion.

6. An assembly as claimed in claim 2, wherein said tightening members are attached to respective said band ends.

7. An assembly as claimed in claim 2, wherein said tightening members are formed integrally with respective said band ends.

8. An assembly as claimed in claim 2, wherein each said tightening member has a surface inclined with respect to the axis of said spindle, each said clamping member has a surface inclined to said spindle axis and abutting said inclined surface of the respective said tightening member, and each said clamping member has a further surface abutting on and guided by a guide surface of said frame to thereby prevent rotation of said clamping member upon rotation of said operating end.

9. An assembly as claimed in claim 8, wherein said spindle comprises an axially outer, larger diameter portion rotatably supported by said frame and an axially inner, smaller diameter portion forming a step with said larger diameter portion, said smaller diameter portion including a smooth section adjacent said step and a threaded section remote from said step, a first said clamping member is threaded onto said threaded section, a second said clamping member has said smooth section loosely extending therethrough and abuts said step, and said operating end comprises means fixed to an outer end of said larger diameter portion for selectively rotating said spindle.

10. An assembly as claimed in claim 8, wherein said spindle extends into and is supported by said frame, a first said clamping member is fixed to an axially inner end of said spindle, a second said clamping member is axially slidably mounted on said spindle, and said operating end comprises a threaded axially outer end portion of said spindle, an internally threaded actuating member threaded onto said outer end portion of said spindle, and a sleeve surrounding a portion of said spindle, said sleeve having an outer flanged end in abutment with said actuating member and an inner end extending into said frame and abutting said second clamping member, whereby rotation of said actuating member in said first direction causes axial movement of said sleeve and second clamping member relative to said spindle and toward said first clamping member.

11. An assembly as claimed in claim 2, wherein said band is fastened to and supported by jaws mounted on said frame.

12. An assembly as claimed in claim 1, wherein said band is formed of a flexible material.

13. A frame for supporting a refractory plate for use in a sliding closure unit of the type for controlling the discharge of molten metal from a metallurgical vessel, said frame comprising:

a recess to receive therein a refractory plate;

a band mounted in said recess to surround the periphery of a plate received therein;

tightening means, mounted in said frame and selectively operable from the exterior thereof, for tightening said band about the periphery of the plate and thereby securely mounting the plate within said recess of said frame, and for loosening said band from the periphery of the plate, whereby the plate may be removed from said band and said frame; and said band being mounted within said recess in said frame by means such that said band remains in position on said frame when said tightening means loosens said band and the plate is removed from said band.

14. A frame as claimed in claim 13, wherein said band is split and has adjacent ends spaced from each other, and said tightening means comprises a pair of tightening members provided at said band ends, a pair of clamping members positioned for engagement with respective said tightening members, and a spindle supporting said clamping members and having an operating end extending from said frame, such that rotation of said operating end in a first direction causes movement of said clamping members toward each other, thereby causing movement of said tightening members and said band ends toward each other, thus tightening said band about the periphery of the plate, and such that rotation of said operating end in a second direction opposite to said first direction causes movement of said clamping members away from each other, thereby enabling movement of said tightening members and said band ends away from each other, thus loosening said band from the periphery of the plate.

15. A frame as claimed in claim 14, wherein said recess is elongated rectilinearly and is defined by spaced elongated side walls joined by rounded end walls, said band is split at positions adjacent each said side wall to define two band portions having adjacent ends spaced from each other at each said position, and a said tightening means is provided at each said position for operation on a respective pair of said band ends.

16. A frame as claimed in claim 14, wherein said recess is round.

17. A frame as claimed in claim 14, wherein said frame includes separable frame portions, said band comprises separate band portions, and each said band portion is fastened to and supported by a respective said frame portion.

18. A frame as claimed in claim 14, wherein said tightening members are attached to respective said band ends.

19. A frame as claimed in claim 14, wherein said tightening members are formed integrally with respective said band ends.

20. A frame as claimed in claim 14, wherein each said tightening member has a surface inclined with respect to the axis of said spindle, each said clamping member has a surface inclined to said spindle axis and abutting said inclined surface of the respective said tightening member, and each said clamping member has a further surface abutting on and guided by a guide surface of said frame to thereby prevent rotation of said clamping member upon rotation of said operating end.

21. A frame as claimed in claim 20, wherein said spindle comprises an axially outer, larger diameter portion rotatably supported by said frame and an axially inner, smaller diameter portion forming a step with said larger diameter portion, said smaller diameter portion including a smooth section adjacent said step and a threaded section remote from said step, a first said clamping member is threaded onto said threaded section, a second said clamping member has said smooth section loosely extending therethrough and abuts said step, and said operating end comprises means fixed to an outer end of said larger diameter portion for selectively rotating said spindle.

22. A frame as claimed in claim 20, wherein said spindle extends into and is supported by said frame, a first said clamping member is fixed to an axially inner end of said spindle, a second said clamping member is axially slidably mounted on said spindle, and said operating end comprises a threaded axially outer end portion of said spindle, an internally threaded actuating member threaded onto said outer end portion of said spindle, and a sleeve surrounding a portion of said spindle, said sleeve having an outer flanged end in abutment with said actuating member and an inner end extending into said frame and abutting said second clamping member, whereby rotation of said actuating member in said first direction causes axial movement of said sleeve and second clamping member relative to said spindle and toward said first clamping member.

23. A frame as claimed in claim 14, wherein said band is fastened to and supported by jaws mounted on said frame.

24. A frame as claimed in claim 13, wherein said band is formed of a flexible material.

* * * * *